US007499659B2

(12) United States Patent
Fukatsu et al.

(10) Patent No.: US 7,499,659 B2
(45) Date of Patent: Mar. 3, 2009

(54) IMAGE-FORMING APPARATUS AND IMAGE-FORMING METHOD

(75) Inventors: Makoto Fukatsu, Mishima (JP); Kazuhisa Kemmochi, Mishima (JP); Keisuke Abe, Sunto-gun (JP)

(73) Assignee: Canon Kabushiki Kaisha (JP)

( * ) Notice: Subject to any disclaimer, the term of this patent is extended or adjusted under 35 U.S.C. 154(b) by 426 days.

(21) Appl. No.: 11/318,195

(22) Filed: Dec. 23, 2005

(65) Prior Publication Data

US 2006/0140677 A1 Jun. 29, 2006

(30) Foreign Application Priority Data

Dec. 28, 2004 (JP) ..... 2004-379427

(51) Int. Cl.
*G03G 15/01* (2006.01)

(52) U.S. Cl. ..... 399/40; 399/231; 399/328

(58) Field of Classification Search ..... 399/223, 399/40, 231, 328
See application file for complete search history.

(56) References Cited

U.S. PATENT DOCUMENTS

2003/0054280 A1 * 3/2003 Ishihara et al. ..... 430/124
2003/0099492 A1 * 5/2003 Maeyama et al. ..... 399/302

FOREIGN PATENT DOCUMENTS

JP 2001-183885 A 7/2001
JP 2006220800 A * 8/2006

* cited by examiner

*Primary Examiner*—David M Gray
*Assistant Examiner*—Bryan Ready
(74) *Attorney, Agent, or Firm*—Rossi, Kimms & McDowell LLP

(57) ABSTRACT

The image-forming apparatus and an image-forming method of the present invention stably provides a high-quality image having a surface with a uniform gloss value, without reduction in image density, and with good fixability. The image-forming apparatus and image-forming method of the present invention provide are characterized in that white toner or transparent toner is used under the conditions that the storage elastic modulus of the white toner or transparent toner at a saturated temperature in a fixing nip at the time of an fixing step is set to be higher than the storage elastic modulus at a saturated temperature in the fixing nip of each colored toner at the time of the fixing step, and that the storage elastic modulus $G'_{(T)}$ (W) or $G'_{(T)}$ (To) at the saturated temperature in the fixing nip of the white toner or the transparent toner at the time of the fixing step is in the range of $1.0\times10^4$ to $1.0\times10^6$ dyn/cm$^2$.

8 Claims, 6 Drawing Sheets

IMAGE-FORMING APPARATUS AND IMAGE-FORMING METHOD

BACKGROUND OF THE INVENTION

1. Field of the Invention

The present invention relates to an image-forming apparatus of an electrophotographic system or an electrostatic recording system such as a copying machine or a printer, and to an image-forming method to be used for the image-forming apparatus.

2. Related Background Art

Various image-forming apparatuses each intended for forming a color image on a transfer material by means of an electrophotographic recording system have been proposed, and some of them have been put into practical use. (see, for example, Japanese Patent Application Laid-Open No. 2001-183885)

FIG. 7 shows an example of the structure of a color image-forming apparatus adopting an in-line system. FIG. 7 is a side view schematically showing the main internal structure of the apparatus. The image-forming apparatus is constituted as a quadruple photosensitive drum-intermediate transfer type color printer of an in-line system.

The color printer of this in-line system includes an intermediate transfer belt 106. The intermediate transfer belt 106 is suspended by a driver roller 107, a driven roller 109, and a tension roller 108, and is rotated in the direction indicated by an arrow A shown in FIG. 7. Four photosensitive drums 101*a* to 101*d* serving as image-bearing members are arranged in series along the intermediate transfer belt 106. The photosensitive-drums-101 and other image-forming means constitute arrangement stations PY, PM, PC, and PK on which image-forming means for forming yellow, magenta, cyan, and black toner images are respectively arranged.

The image-forming means on the arrangement stations PY, PM, PC and PK are respectively constituted by the photosensitive drums 101*a* to 101*d*, and charging devices 102*a* to 102*d*, exposing devices 103*a* to 103*d*, developing devices 104*a* to 104*d*, and photosensitive drum cleaners 105*a* to 105*d* arranged around the corresponding photosensitive drums. The image-forming means for the respective colors have substantially the same structure except that yellow toner, magenta toner, cyan toner and black toner are stored in the developing devices 104*a* to 104*d*, respectively.

The operation of forming a full-color (four-color) image will be described. At first, each of the photosensitive drums 101 rotates, and its surface is uniformly charged by the corresponding one of the charging devices 102. Next, each of the exposing devices 103 irradiates a laser beam modulated in accordance with image data, so a desired electrostatic latent image corresponding to each color is formed on the surface of each of the photosensitive drums 101. The electrostatic latent images on the respective photosensitive drums 101 are developed at developing positions by the respective developing devices 104 with colored toners so as to be visualized as yellow, magenta, cyan, and black toner images, respectively.

The toner images of the respective colors formed on the photosensitive drums 101 are electrostatically transferred onto the intermediate transfer belt 106 at respective transfer nip portions opposed to the photosensitive drums 101 by transfer rollers 110 of transferring means in such a manner that the toner images are sequentially superimposed on each other. A transfer material P is fed from sheet-feeding means to a secondary transfer nip portion between the intermediate transfer belt 106 and a secondary transfer roller 112 via conveying means, and then the toner images on the intermediate transfer belt 106 are electrostatically and collectively transferred onto the transfer material P.

Residual toner on the photosensitive drums 101 after the transfer is removed by the photosensitive drum cleaners 105 each equipped with a cleaning blade or the like so as to be ready for a next image-forming step.

Residual toner on the intermediate transfer belt 106 after the secondary transfer is removed by an intermediate transfer belt cleaner 111 so as to be ready for a next image-forming step.

As shown in FIG. 8, the toner images of the four colors are collectively transferred onto the transfer material P as described above to be formed on the transfer material P. In FIG. 8, M denotes magenta toner, C denotes cyan toner, Y denotes yellow toner, and K denotes black toner.

Here, a toner layer is pressurized and heated in a fixing nip by a fixing roller 126 and a pressure roller 127 in a fixing unit 125 shown in FIG. 7 to be fixed on the transfer material P.

At this time, in the case where the storage elastic modulus $G'_{(T)}$ at a saturated temperature (T) in the fixing nip of each toner at the time of a fixing step is low, the excessive impregnation of the toner layer into the transfer material may occur as shown in FIG. 9 when the toner layer is pressurized and heated. As a result, as shown in FIG. 10, a paper fiber appears on the surface of an image, so the uniformity of the gloss value of the surface of the image is lost and an image density reduces. Thus, there may arise a problem in that a desired image cannot be obtained.

In view of the foregoing, attempts have been made to increase the storage elastic modulus $G'_{(T)}$ at a saturated temperature in a fixing nip of each toner at the time of a fixing step by means of a method involving reducing a saturated temperature in the fixing nip at the time of the fixing step or changing the kind of the toner itself. In this method, however, toner insufficiently melts to reduce the gloss value of the surface of an image or to generate a factor of the deterioration of the fixability of a toner image on a transfer material. As a result, there may arise a problem in that a desired image cannot be obtained.

SUMMARY OF THE INVENTION

The present invention has been made in view of the above problems, and an object of the present invention is as follows. That is, an object of the present invention is to provide an image-forming apparatus and an image-forming method each capable of sufficiently melting a toner image in a fixing step to provide a desired gloss value and preventing the excessive impregnation of the toner image into a transfer material. With such apparatus and method, a high-quality image which has a surface with a uniform gloss value, which shows no reduction in image density, and which has good fixability can be stably obtained.

The above problems can be solved by the image-forming apparatus and the image-forming method according to the present invention.

(1) According to one aspect of the present invention, there is provided an image-forming apparatus for forming a multi-color toner image by superimposing a plurality of colored toners, the image-forming apparatus performing: an image-forming step of forming a white toner image between a transfer material and the multi-color toner image by developing and transferring white toner corresponding to the multi-color toner image; and a fixing step of fixing the multi-color toner image and the white toner image on the transfer material, wherein the storage elastic modulus $G'_{(T)}$ (W) at a saturated temperature in a fixing nip of the white toner at the time of the fixing step is higher than the storage elastic modulus at the saturated temperature in the fixing nip of each of the colored toners at the time of the fixing step; and wherein the storage elastic modulus $G'_{(T)}$ (W) at the saturated temperature in the fixing nip of the white toner at the time of the fixing step is $1.0\times10^4$ dyn/cm$^2$ or more and $1.0\times10^6$ dyn/cm$^2$ or less.

The image-forming apparatus of the present invention forms a white toner image between a transfer material and a multi-color toner image. Then, as shown in FIG. 6, the storage elastic modulus $G'_{(T)}$ (W) at the saturated temperature in the fixing nip of the white toner at the time of the fixing step is set to be higher than the storage elastic modulus at the saturated temperature in the fixing nip of each colored toner at the time of the fixing step. Thus, toner layers on the transfer material can be different from each other in viscosity at the time of melting, so toner closer to the transfer material is less likely to melt, and toner on the surface side of an image is likely to melt. As a result, excessive impregnation of a toner layer into the transfer material can be suppressed, and the surface of the image can be provided with a desired gloss value.

Furthermore, the storage elastic modulus $G'_{(T)}$ (W) at the saturated temperature in the fixing nip of the white toner at the time of the fixing step is set to be $1.0\times10^4$ dyn/cm$^2$ or more and $1.0\times10^6$ dyn/cm$^2$ or less. As a result, the white toner in contact with the transfer material can melt to such an extent that the toner does not excessively impregnate into the transfer material and fixability is not impaired.

(2) According to another aspect of the present invention, there is provided an image-forming apparatus for forming a multi-color toner image by superimposing a plurality of colored toners, the image-forming apparatus performing: an image-forming step of forming a transparent toner image between a transfer material and the multi-color toner image by developing and transferring transparent toner corresponding to the multi-color toner image; and a fixing step of fixing the multi-color toner image and the transparent toner image on the transfer material, wherein the storage elastic modulus $G'_{(T)}$ (To) at a saturated temperature in a fixing nip of the transparent toner at the time of the fixing step is higher than the storage elastic modulus $G'_{(T)}$ at the saturated temperature in the fixing nip of each of the colored toners at the time of the fixing step; and wherein the storage elastic modulus $G'_{(T)}$ (To) at the saturated temperature in the fixing nip of the transparent toner at the time of the fixing step is $1.0\times10^4$ dyn/cm$^2$ or more and $1.0\times10^6$ dyn/cm$^2$ or less.

The image-forming apparatus of the present invention forms a transparent toner image between a transfer material and a multi-color toner image. Then, as shown in FIG. 6, the storage elastic modulus $G'_{(T)}$ (To) at the saturated temperature in the fixing nip of the transparent toner at the time of the fixing step is set to be higher than the storage elastic modulus at the saturated temperature in the fixing nip of each colored toner at the time of the fixing step. Thus, toner layers can be different from each other in viscosity at the time of melting, so toner closer to the transfer material is less likely to melt, and toner on the surface side of an image is likely to melt. As a result, excessive impregnation of a toner layer into the transfer material can be suppressed, and the surface of the image can be provided with a desired gloss value.

Furthermore, the storage elastic modulus $G'_{(T)}$ (To) at the saturated temperature in the fixing nip of the transparent toner at the time of the fixing step is set to be $1.0\times10^4$ dyn/cm$^2$ or more and $1.0\times10^6$ dyn/cm$^2$ or less. As a result, the transparent toner in contact with the transfer material can melt to such an extent that the toner does not excessively impregnate into the transfer material and fixability is not impaired.

(3) According to another aspect of the present invention, there is provided an image-forming method of forming a multi-color toner image by superimposing a plurality of colored toners, the image-forming method including: an image-forming step of forming a white toner image between a transfer material and the multi-color toner image by developing and transferring white toner corresponding to the multi-color toner image; and a fixing step of fixing the multi-color toner image and the white toner image on the transfer material, wherein the storage elastic modulus $G'_{(T)}$ (W) at a saturated temperature in a fixing nip of the white toner at the time of the fixing step is higher than the storage elastic modulus at the saturated temperature in the fixing nip of each of the colored toners at the time of the fixing step; and wherein the storage elastic modulus $G'_{(T)}$ (W) at the saturated temperature in the fixing nip of the white toner at the time of the fixing step is $1.0\times10^4$ dyn/cm$^2$ or more and $1.0\times10^6$ dyn/cm$^2$ or less.

The image-forming method of the present invention is used to form a white toner image between a transfer material and a multi-color toner image. Then, as shown in FIG. 6, the storage elastic modulus $G'_{(T)}$ (W) at the saturated temperature in the fixing nip of the white toner at the time of the fixing step is set to be higher than the storage elastic modulus at the saturated temperature in the fixing nip of each colored toner at the time of the fixing step. Thus, toner layers can be different from each other in viscosity at the time of melting, so toner closer to the transfer material is less likely to melt, and toner on the surface side of an image is likely to melt. As a result, excessive impregnation of a toner layer into the transfer material can be suppressed, and the surface of the image can be provided with a desired gloss value.

Furthermore, the storage elastic modulus $G'_{(T)}$ (W) at the saturated temperature in the fixing nip of the white toner at the time of the fixing step is set to be $1.0\times10^4$ dyn/cm$^2$ or more and $1.0\times10^6$ dyn/cm$^2$ or less. As a result, the white toner in contact with the transfer material can melt to such an extent that the toner does not excessively impregnate into the transfer material and fixability is not impaired.

(4) According to another aspect of the present invention, there is provided an image-forming method of forming a multi-color toner image by superimposing a plurality of colored toners, the image-forming method including: an image-forming step of forming a transparent toner image between a transfer material and the multi-color toner image by developing and transferring transparent toner corresponding to the multi-color toner image; and a fixing step of fixing the multi-color toner image and the transparent toner image on the transfer material, wherein the storage elastic modulus $G'_{(T)}$ (To) at a saturated temperature in a fixing nip of the transparent toner at the time of the fixing step is higher than the storage elastic modulus at the saturated temperature in the fixing nip of each of the colored toners at the time of the fixing step; and wherein the storage elastic modulus $G'_{(T)}$ (To) at the saturated temperature in the fixing nip of the transparent toner at the time of the fixing step is $1.0\times10^4$ dyn/cm$^2$ or more and $1.0\times10^6$ dyn/cm$^2$ or less.

The image-forming method of the present invention is used to form a transparent toner image between a transfer material and a multi-color toner image. Then, as shown in FIG. 6, the storage elastic modulus $G'_{(T)}$ (To) at the saturated temperature in the fixing nip of the transparent toner at the time of the fixing step is set to be higher than the storage elastic modulus at the saturated temperature in the fixing nip of each colored toner at the time of the fixing step. Thus, toner layers can be different from each other in viscosity at the time of melting, so toner closer to the transfer material is less likely to melt, and toner on the surface side of an image is likely to melt. As a result, excessive impregnation of a toner layer into the transfer material can be suppressed, and the surface of the image can be provided with a desired gloss value.

Furthermore, the storage elastic modulus $G'_{(T)}$ (To) at the saturated temperature in the fixing nip of the transparent toner at the time of the fixing step is set to be $1.0\times10^4$ dyn/cm$^2$ or more and $1.0\times10^6$ dyn/cm$^2$ or less. As a result, the transparent toner in contact with the transfer material can melt to such an extent that the toner does not excessively impregnate into the transfer material and fixability is not impaired.

DESCRIPTION OF THE PREFERRED EMBODIMENTS

Figure 1:
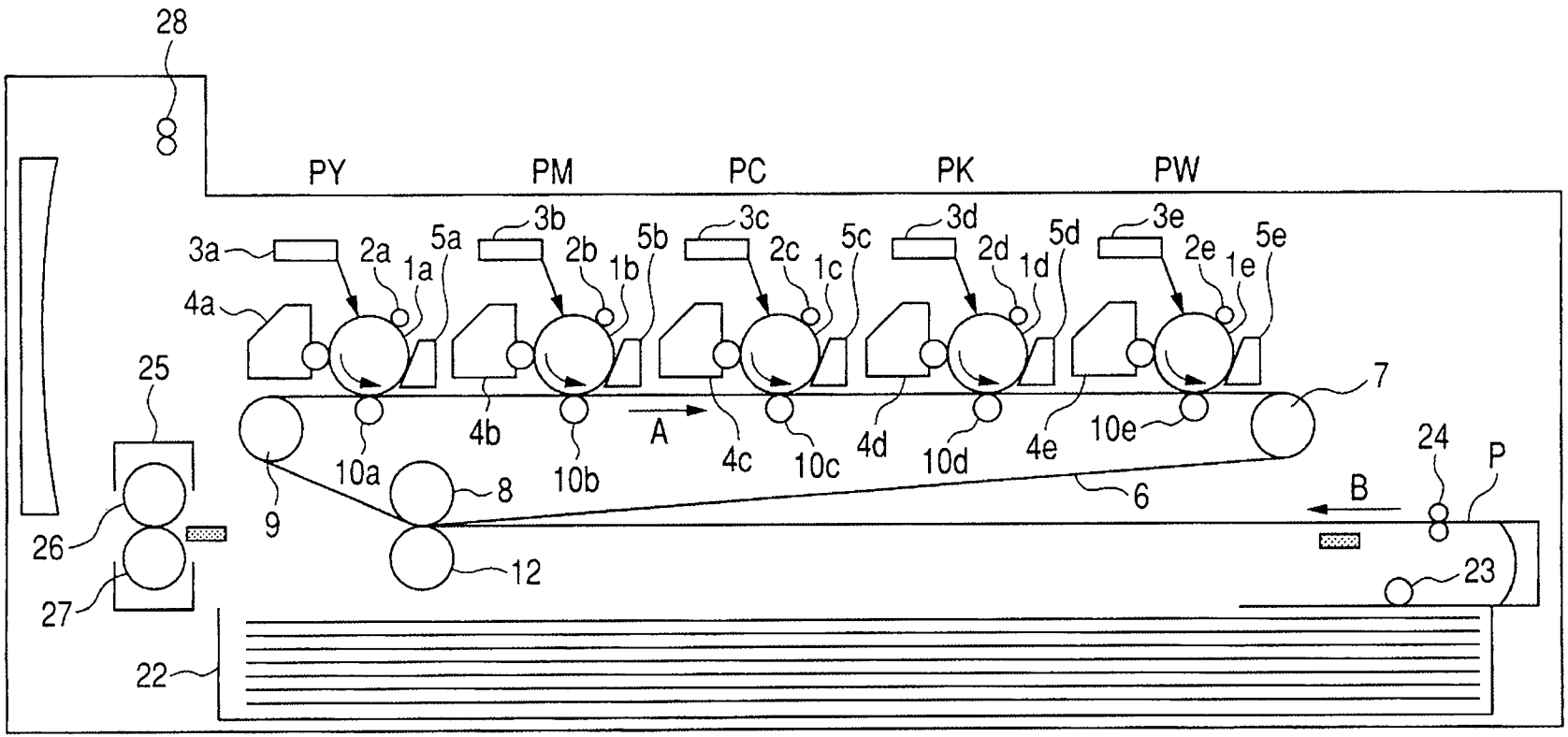
FIG. 1 is a structural view showing a first example of an image-forming apparatus of the present invention.

The present invention can provide an image-forming apparatus and an image-forming method each capable of sufficiently melting a toner image in a fixing step to provide a desired gloss value and preventing the excessive impregnation of the toner image into a transfer material. As the result, such apparatus and method make it possible to stably obtain a high-quality image which has a surface with a uniform gloss value, which shows no reduction in image density, and which has good fixability can be.

Hereinafter, an example according to the present invention will be described in more detail with reference to the drawings.

A saturated temperature (T) in a fixing nip at the time of a fixing step in this example was determined as follows. At first, a K type 50-μm thermocouple was attached to a transfer material such as recording paper, and then the thermocouple and the recording paper were passed through a fixing device to obtain a temperature increase curve in the fixing nip. The maximum temperature in the obtained temperature increase curve was defined as "saturated temperature (T)" in the fixing nip.

The storage elastic modulus G' of toner in this example was measured by means of a dynamic viscoelasticity measuring device such as an RMS-800 manufactured by Rheometric Scientific.

A specific measurement method is as follows. At first, about 1 gram of a sample was fixed between plates of a parallel plate test fixture (followed by being heated for several minutes at about 110° C.). Then, a strain of a torsion reciprocating motion of 62.8 rad/sec was applied from one of the plates, and a stress with respect to the strain was detected by the other plate. A strain rate at this time was automatically changed (up to 20%). A temperature was increased in this state to measure the temperature dependence of viscoelasticity. The storage elastic modulus $G'_{(T)}$ of toner at the saturated temperature (T [° C.]) in the fixing nip at the time of the fixing step was determined from the measured result.

A fixability test for a fixed image in this example involved: rubbing the obtained resultant image with lens-cleaning paper 10 times reciprocally with a load of about 100 g applied to the image; and evaluating the peeling of an image on the basis of a reduction rate (%) of a reflection density thereof.

In the fixability test, if the reduction rate (%) of reflection density of an image is 10% or less, fixablility is good. If the reduction rate exceeds 20%, this case is not preferable because there is generated a problem that characters are peeled off, a half tone image becomes fade and hands, dresses and other papers are soiled when users use an image.

Also, the estimation of gloss value of a fixed image in the present example and the estimation of gloss uniformity were performed by using a gloss value meter VG2000 (trade name) manufactured by Nippon Denshoku Industries Co., Ltd. and using a 60 degrees mirror finished surface gloss-measuring method in JIS Z 8741.

Further, the density estimation of a fixed image in the present example was performed by using Gretag Macbeth RD918 (trade name) as an apparatus of measuring a reflection density and measuring the reflection density of a fixed image. Furthermore, the permeated density estimation of a fixed image was performed by using Gretag Macbeth TD904 (trade name) as an apparatus of measuring a permeated density and measuring the permeated density of a fixed image.

Examples of a method of changing the storage elastic modulus $G'_{(T)}$ at the saturated temperature in the fixing nip of toner as described in this example include the following, for example, a method of changing the temperature setting of a fixing roller to change the saturated temperature (T) in a fixing nip, whereby the storage elastic modulus $G'_{(T)}$ at the saturated temperature in the fixing nip is changed, and a method of changing the molecular weight and molecular weight distribution of a binder resin of toner, the cross-linking rate of a polymer chain, and the like to change the viscoelasticity of the toner, whereby the storage elastic modulus $G'_{(T)}$ at the saturated temperature in the fixing nip is changed.

Examples of the binder resin of the toner include: polyester; polystyrene; polymer compounds obtained from styrene derivatives such as poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-α-methyl chloromethacrylate copolymer, a styrene-acrylonitrile copolymer, a styrene-vinyl methyl ketone copolymer, a styrene-butadiene copolymer, a styrene-isoprene copolymer, and a styrene-acrylonitrile-indene copolymer; polyvinyl chloride;

a phenol resin; a denatured phenol resin; a maleic resin; an acrylic resin; a methacrylic resin; polyvinyl acetate; a silicone resin; a polyester resin having, as a structural unit, a monomer selected from an aliphatic polyhydric alcohol, an aliphatic dicarboxylic acid, an aromatic dicarboxylic acid, an aromatic dialcohol, and a diphenol; a polyurethane resin; a polyamide resin; polyvinyl butyral; a terpene resin; a coumarone-indene resin; and a petroleum resin.

Examples of a monomer preferably used in a method of directly obtaining a toner particle by means of a polymerization method include: styrene; styrene monomers such as o (m-, p-)-methylstyrene and m (p-)-ethylstyrene; (meth)acrylate monomers such as methyl(meth)acrylate, ethyl(meth) acrylate, propyl (meth)acrylate, butyl(meth)acrylate, octyl (meth)acrylate, dodecyl(meth)acrylate, stearyl (meth)acrylate, behenyl(meth)acrylate, 2-ethylhexyl (meth)acrylate, dimethylaminoethyl(meth)acrylate, and diethylaminoethyl (meth)acrylate; and ene monomers such as butadiene, isoprene, cyclohexene, (meth)acrylonitrile, and amide acrylate.

At least silica fine particles and/or titanium oxide fine particles are preferably used as external additives for toner because good fluidity can be imparted to a developer and the lifetime of the developer is lengthened. In addition, the use of those fine powders allows the developer to show a reduced environmental fluctuation.

Examples of other external additives include a metal oxide fine powder (such as aluminum oxide, strontium titanate, cerium oxide, magnesium oxide, chromium oxide, tin oxide, or zinc oxide), a nitride fine powder (such as silicon nitride), a carbide fine powder (such as silicon carbide), a metal salt fine powder (such as calcium sulfate, barium sulfate, or calcium carbonate), an aliphatic acid metal salt fine powder (such as zinc stearate or calcium stearate), carbon black, and a resin fine powder (such as polytetrafluoroethylene, polyvinylidene fluoride, polymethyl methacrylate, polystyrene, or a silicone resin). Each of those external additives may be used alone, or two or more of them may be used in combination. The above external additives including a silica fine powder are more preferably subjected to a hydrophobic treatment.

A toner particle and an external additive can be mixed by means of a mixer such as a Henschel mixer.

Examples of a colorant to be used for a toner include the following.

Examples of a yellow colorant to be used include compounds typified by a condensed azo compound, an isoindolinone compound, an anthraquinone compound, an azo metal complex, a methine compound, and an allylamide compound. Specific examples of a yellow colorant that can be suitably used include C.I. Pigment Yellow 12, 13, 14, 15, 17, 62, 74, 83, 93, 94, 95, 109, 110, 111, 128, 129, 147, and 168.

Examples of a magenta colorant to be used include a condensed azo compound, a diketopyrrolopyrrole compound, anthraquinone, a quinacridone compound, a base dye lake compound, a naphthol compound, a benzimidazolone compound, a thioindigo compound and a perylene compound. Specific examples of a magenta colorant that can be suitably used include C.I. Pigment Red 2, 3, 5, 6, 7, 23, 48:2, 48:3, 48:4, 57:1, 81:1, 144, 146, 166, 169, 177, 184, 185, 202, 206, 220, 211 and 254.

Examples of a cyan colorant include: a copper phthalocyanine compound and a derivative thereof; an anthraquinone compound; and a base dye lake compound. Specific examples of a cyan colorant that can be suitably used include C.I. Pigment Blue 1, 7, 15, 15:1, 15:2, 15:3, 15:4, 60, 62, and 66.

Each of those colorants can be used alone, or two or more of them can be used as a mixture. In addition, each of them can be used in the state of a solid solution.

An example of a black colorant includes one obtained by using carbon black, a magnetic body, and any one of the above yellow/magenta/cyan colorants to provide a black color.

Examples of a white colorant include zinc white, titanium oxide, antimony white, and zinc sulfide.

In the case of color toner, a colorant is selected in consideration of a hue angle, chroma, brightness, weatherability, OHP transparency, and dispersibility into the toner. The content of the colorant is preferably 1 to 20 parts by mass with respect to 100 parts by mass of a binder resin for toner.

A conventionally known charge control agent can be used for toner. In the case of color toner, a charge control agent which is colorless or has a pale color, which increases the charging speed of toner, and which can stably maintain a constant charge amount is particularly preferable. Furthermore, in the present invention, a charge control agent having no polymerization inhibition property and containing no matter soluble in an aqueous medium is particularly preferable in the case where toner is produced by means of a polymerization method.

Examples of a negative charge control agent to be used include: metal compounds of salicylic acid, dialkylsalicylic acid, naphthoic acid, and dicarboxylic acid, or derivative's thereof; polymer compounds each having a sulfonic acid or a carboxylic acid at a side chain thereof; boron compounds; urea compounds; silicon compounds; and calixarene. Examples of a positive charge control agent include: a quaternary ammonium salt; a polymer compound having the quaternary ammonium salt at a side chain thereof; a guanidine compound; and an imidazole compound. The content of the charge control agent is preferably 0.5 to 10 parts by mass with respect to 100 parts by mass of the binder resin. However, it is not essential to add a charge control agent to toner particles.

Examples of a method of producing toner particles include: a method involving melting and kneading a binder resin, a colorant, and any other internal additive, cooling the kneaded product, and pulverizing and classifying the cooled product; a method involving directly producing toner particles by means of suspensions polymerization; a dispersion polymerization method of directly producing toner particles by means of an aqueous organic solvent into which a monomer to be used is soluble and a polymer to be obtained is insoluble; and a method of producing toner particles by means of emulsion polymerization, typified by a soap-free polymerization method involving producing toner particles through direct polymerization in the presence of a water-soluble polar polymerization initiator.

Examples of a polymerization initiator to be used for producing toner particles by means of a polymerization method include: azo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-based polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide.

The amount of a polymerization initiator to be added, which varies depending on a target degree of polymerization, is generally 0.5 to 20 mass % with respect to a monomer. The number of kinds of polymerization initiators to be used, which slightly varies depending oh a polymerization method, is one or two or more with reference to a 10-hour half-life temperature. A conventionally known cross-linking agent, chain transfer agent, polymerization inhibitor, or the like may be further added for controlling a degree of polymerization.

Examples of an inorganic oxide that can be used as a dispersant in the case where suspension polymerization is employed as a method of producing toner include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of an organic compound that can be used include polyvinyl alcohol, gelatin, methylcellulose, methylhydroxypropylcellulose, ethylcellulose, a sodium salt of carboxymethylcellulose, and starch. Each of those dispersants is dispersed into an aqueous phase before use. The amount of each of those dispersants is preferably 0.2 to 10.0 parts by mass with respect to 100 parts by mass of a polymerizable monomer.

A commercially available one may be used as it is as each of those dispersants. Alternatively, the inorganic compounds can be produced in a dispersion medium under high-speed stirring in order to obtain dispersed particles having fine and uniform grain sizes. For example, in the case of tricalcium phosphate, a dispersant suitable for a suspension polymerization method can be obtained by mixing an aqueous solution of sodium phosphate and an aqueous solution of calcium chloride under high-speed stirring. A surfactant may be used in an amount of 0.001 to 0.1 part by mass for refining each of those dispersants. Specifically, the following commercially available nonionic, anionic, or cationic surfactants can be used: sodium dodecyl sulfate, sodium tetradecyl sulfate, sodium pentadecyl sulfate, sodium octyl sulfate, sodium oleate, sodium laurate, potassium stearate, and calcium oleate.

When a direct polymerization method is employed as a method of producing toner, toner can be specifically produced by means of such production method as described below. A releasing agent, a colorant, a charge control agent, a polymerization initiator, and any other additive are added to monomers, and the mixture is uniformly dissolved or dispersed by means of a homogenizer, an ultrasonic dispersing device, or the like to prepare a monomer composition. The monomer composition is dispersed into an aqueous phase containing a dispersion stabilizer by means of a stirring device, a homomixer, a homogenizer, or the like. Preferably, a droplet composed of the monomer composition is granulated with a stirring speed and a stirring time adjusted in order to provide a desired size of toner particles. After that, stirring has only to be performed to the extent that a particle state is maintained by an action of a dispersion stabilizer and the sedimentation of a particle is prevented. Polymerization is performed at a temperature of 40° C. or higher, or generally at 50 to 90° C. The polymerization temperature may be increased in the latter half of a polymerization reaction. Furthermore, a part of an aqueous medium may be distilled off in the latter half of or after the completion of the reaction in order to remove an unreacted polymerizable monomer and a by-product for the purpose of improving durability. After the completion of the reaction, the produced toner particles are washed, collected through filtration, and dried. In a suspension polymerization method, in general, 300 to 3,000 parts by mass of water are preferably used as a dispersion medium with respect to 100 parts by mass of a monomer system.

The term "colored toner" as used herein refers to toner except for transparent toner and white toner. Specific examples of the colored toners are, for example, yellow toner, magenta toner, cyan toner, and black toner. A colored toner with an increased amount of a colorant and a colored toner with a reduced amount of a colorant may be used in combination.

In the present invention, the storage elastic modulus at a saturated temperature (T) in a fixing nip of white toner is denoted by $G'_{(T)}$ (W), and the storage elastic modulus at the saturated temperature (T) in the fixing nip of transparent toner is denoted by $G'_{(T)}$ (To). In addition, the storage elastic modulus at the saturated temperature (T) in the fixing nip of yellow toner is denoted by $G'_{(T)}$ (Y), and the storage elastic modulus at the saturated temperature (T) in the fixing nip of magenta toner is denoted by $G'_{(T)}$ (M). In addition, the storage elastic modulus at the saturated temperature (T) in the fixing nip of cyan toner is denoted by $G'_{(T)}$ (C), and the storage elastic modulus at the saturated temperature (T) in the fixing nip of black toner is denoted by $G'_{(T)}$ (K).

When white toner, yellow toner, magenta toner, cyan toner, and black toner are used, the storage elastic moduli at the saturated temperature (T) in the fixing nip of the respective toners preferably satisfy the following relationships:

$$G'_{(T)}(W)>G'_{(T)}(Y)$$

$$G'_{(T)}(W)>G'_{(T)}(M)$$

$$G'_{(T)}(W)>G'_{(T)}(C)$$

$$G'_{(T)}(W)>G'_{(T)}(K).$$

When transparent toner, yellow toner, magenta toner, cyan toner, and black toner are used, the storage elastic moduli at the saturated temperature (T) in the fixing nip of the respective toners preferably satisfy the following relationships:

$$G'_{(T)}(To)>G'_{(T)}(Y)$$

$$G'_{(T)}(To)>G'_{(T)}(M)$$

$$G'_{(T)}(To)>G'_{(T)}(C)$$

$$G'_{(T)}(To)>G'_{(T)}(K).$$

Hereinafter, examples of the present invention will be described. However, the present invention is not limited to these examples.

Toner in each of examples and comparative examples was produced by means of the following method.

[Method of Producing White Toner 1]

3 parts by mass of tricalcium phosphate were added to 900 parts by mass of ion-exchanged water heated to 70° C., and the mixture was stirred at 10,000 rpm by means of a TK Homomixer (manufactured by TOKUSHU KIKA KOGYO CO., LTD.) to produce an aqueous medium.

| | |
|---|---|
| Styrene | 80.0 parts by mass |
| n-butyl acrylate | 20.0 parts by mass |
| Divinylbenzene | 1.0 part by mass |
| Saturated polyester resin | 4.5 parts by mass |

(Polycondensate of propylene oxide-denatured bisphenol A and isophthalic acid, glass transition temperature (Tg)=65° C., number average molecular weight (Mn)=17,000, weight average molecular weight (Mw)/number average molecular weight (Mn)=2.4) Aluminum salicylate compound

| | |
|---|---|
| (BONTRON E-88, manufactured by Orient Chemical Industries, Ltd.) | 1.0 part by mass |
| Antimony white | 6.0 parts by mass |

The above materials were uniformly dispersed and mixed by means of an Attritor (manufactured by Mitsui Miike Machinery Co., Ltd.) to prepare a polymerizable monomer composition. After the polymerizable monomer composition had been heated to 63° C., 9 parts by mass of ester wax mainly composed of stearyl stearate were added to, mixed into, and dissolved into the composition. Then, 3 parts by mass of 2,2'-azobis-2-methylbutyronitrile were dissolved into the composition to prepare a polymerizable monomer mixture.

The polymerizable monomer mixture was loaded into an aqueous medium, and the mixture was stirred at 63° C. under an $N_2$ atmosphere by means of a TK Homomixer at 10,000 rpm for 7 minutes for granulation. After that, the mixture was reacted at 63° C. for 6 hours while being stirred by means of a paddle stirring blade. After that, the mixture liquid was cooled to 80° C. and further continuously stirred for 4 hours. After the completion of the reaction, the obtained suspension was cooled to room temperature (25° C.), and then hydrochloric acid was added to the suspension to dissolve a calcium phosphate salt. The obtained product was filtered and washed with water to produce wet toner particles.

Next, the toner particles were dried at 40° C. for 12 hours to produce toner particles having a weight average particle size of 7.6 μm.

100 parts by mass of the toner particles and 0.7 part by mass of a hydrophobic silica fine powder treated with silicone oil, the powder having a BET value of 200 $m^2/g$ and a primary particle size of 12 nm, were mixed by means of a Henschel mixer (manufactured by Mitsui Miike Machinery Co., Ltd.) to produce White Toner 1.

[Method of Producing White Toner 2]

White Toner 2 was produced in the same manner as in White Toner 1 except that 0.8 part by mass of divinylbenzene was used as shown in Table 1.

[Method of Producing White Toner 3]

White Toner 3 was produced in the same manner as in White Toner 1 except that 2.0 parts by mass of divinylbenzene were used as shown in Table 1.

[Method of Producing White Toner 4]

White Toner 4 was produced in the same manner as in White Toner 1 except that 0.6 part by mass of divinylbenzene was used as shown in Table 1.

[Method of Producing Transparent Toner 1]

Transparent Toner 1 was produced in the same manner as in White Toner 1 except that no white pigment was used.

[Methods of Producing Yellow Toner 1, Magenta Toner 1, Cyan Toner 1, and Black Toner 1]

Yellow Toner 1 was produced in the same manner as in White Toner 1 except that: 0.5 part by mass of divinylbenzene was used; and 6.0 parts by mass of a yellow colorant (C.I. Pigment Yellow 74) were used instead of the white colorant (antimony white).

In addition, Magenta Toner 1 was produced in the same manner as in Yellow Toner 1 except that 6.0 parts by mass of a magenta colorant (C.I. Pigment Red 122) were used instead of the yellow colorant.

In addition, Cyan Toner 1 was produced in the same manner as in Yellow Toner 1 except that 6.0 parts by mass of a cyan colorant (C.I. Pigment Blue 15:3) were used instead of the yellow colorant.

In addition, Black Toner 1 was produced in the same manner as in Yellow Toner 1 except that 6.0 parts by mass of carbon black were used instead of the yellow colorant.

[Methods of Producing Yellow Toner 2, Magenta Toner 2, Cyan Toner 2, and Black Toner 2]

Yellow Toner 2 was produced in the same manner as in Yellow Toner 1 except that 1.5 parts by mass of divinylbenzene were used.

Magenta Toner 2 was produced in the same manner as in Magenta Toner 1 except that 1.5 parts by mass of divinylbenzene were used.

Cyan Toner 2 was produced in the same manner as in Cyan Toner 1 except that 1.5 parts by mass of divinylbenzene were used.

Black Toner 2 was produced in the same manner as in Black Toner 1 except that 1.5 parts by mass of divinylbenzene were used.

EXAMPLE 1

FIG. 1 is a structural view showing an example of the image-forming apparatus of the present invention. The image-forming apparatus is a color printer of an in-line intermediate transfer system in which four arrangement stations PY to PK, and an arrangement station PW having a cartridge filled with White Toner 1 thereon are arranged in parallel along an intermediate transfer belt 6.

This example is characterized in that: the image-forming apparatus is equipped with a developing device storing White Toner 1 as well as four developing devices storing colored toners, that is, Yellow Toner 1, Magenta Toner 1, Cyan-Toner 1, and Black Toner 1; the storage elastic modulus $G'_{(T)}$ (W) at a saturated temperature in a fixing nip of the white toner at the time of a fixing step is higher than the storage elastic modulus at the saturated temperature in the fixing nip of each of the colored toners at the time of the fixing step; and the storage elastic modulus $G'_{(T)}$ (W) at the saturated temperature in the fixing nip of the white toner at the time of the fixing step is in the range from $1.0\times10^4$ dyn/$cm^2$ to $1.0\times10^6$ dyn/$cm^2$.

The saturated temperature (T) in the fixing nip and the storage elastic modulus of the toner of each color in this example were measured. As a result, $G'_{(T)}$ (W) was $2.0\times10^5$, and each of $G'_{(T)}$ (Y), $G'_{(T)}$ (M), $G'_{(T)}$ (C), and $G'_{(T)}$ (K) was $1.5\times10^4$. Table 2 shows the results.

Hereinafter, an image-forming operation in the image-forming apparatus will be described with reference to FIG. 1.

Each of photosensitive drums 1*a* to 1*e* rotates, and its surface is uniformly charged by the corresponding one of charging devices 2*a* to 2*e*. Next, each of exposing devices 3*a* to 3*e* irradiates a laser beam modulated in accordance with image data, so that a desired electrostatic latent image corresponding to each color is formed on the surface of each of the photosensitive drums 1*a* to 1*e*.

Here, the photosensitive drum 1*e* in the arrangement station PW is irradiated with a laser beam modulated in accordance with all colored image date from the exposing device 3*e*, so that a desired electrostatic latent image is formed on the surface of the photosensitive drum 1*e*.

The electrostatic latent images on the respective photosensitive drums 1*a* to 1*e* are developed at developing positions by the respective developing devices 4*a* to 4*e* with respective toners so as to be visualized as yellow, magenta, cyan, black, and white toner images, respectively.

Through the above image-forming operation, at first, in the arrangement station PY for the first color, a yellow toner image is formed on the photosensitive drum 1*a*. During the formation, a transfer material P such as recording paper is fed from a recording material storage portion 22 such as a cassette by a sheet-feeding roller 23 and conveyed to a pair of resist rollers 24. The transfer material P is temporarily stopped at the pair of resist rollers 24. In association with the rotation of the transfer belt 6, the yellow toner image on the photosensitive drum 1*a* is electrostatically transferred onto the intermediate transfer belt 6 at a transfer portion by a voltage, which is opposite in polarity to toner, to be applied to a transfer roller 10*a* arranged inside the transfer belt 6.

Next, in the arrangement stations PM, PC, PK, and PW for the second, third, fourth and fifth colors, magenta, cyan, black and white toner images are formed on the photosensitive drums 1*b*, 1*c*, 1*d*, and 1*e* through similar steps. Next, the toner images are sequentially transferred onto the intermediate transfer belt 6, so that a color image in which toner images of four colors and a white toner image are transferred in a multilayer manner is formed on the intermediate transfer belt 6.

Residual toner on the photosensitive drums 1 after the transfer is removed by drum cleaners 5 each equipped with a cleaning blade or the like so as to be ready for a next image-forming step.

Thus, the transfer material P temporarily stopped at the pair of resist rollers 24 is fed at a predetermined timing to a secondary transfer nip portion between the intermediate transfer belt 6 and a secondary transfer roller 12, and then the toner images on the intermediate transfer belt 6 are electrostatically and collectively transferred onto the transfer material P.

Residual toner on the intermediate transfer belt 6 after the secondary transfer is removed by an intermediate transfer belt cleaner (not shown) so as to be ready for a next image-forming step.

Figure 3:
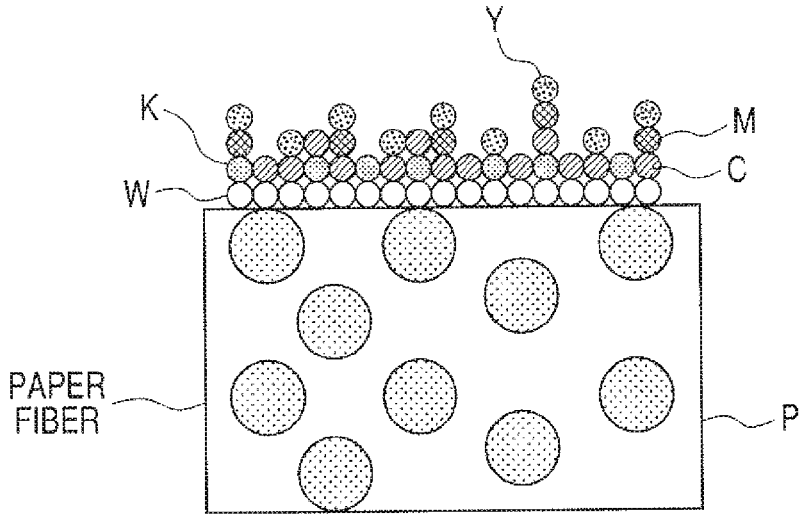
FIG. 3 is an explanatory view showing a state where toner layers are superimposed after transfer in an example of the present invention.

As shown in FIG. 3, in the toner images formed by transferring the four colors and the white toner image onto the transfer material P as described above, the white toner image is formed on the transfer material P at a position in contact with the transfer material, and the colored toner images are formed on the white toner image. In FIG. 3, M denotes magenta toner, C denotes cyan toner, Y denotes yellow toner, K denotes black toner, and W denotes white toner.

After that, a toner layer is pressurized and heated in a fixing nip by a fixing roller 26 and a heating roller 27 in a fixing unit 25 to be fixed on the transfer material P.

Here, the fixing unit 25 in this example will be described in detail.

The fixing roller 26 adopts a concentric three-layer structure, and has a core portion, an elastic layer, and a releasing layer. The core portion is composed of an aluminum hollow pipe having a diameter of 44 mm and a thickness of 5 mm. The elastic layer is composed of silicone rubber having a JIS-A hardness of 50 degrees and a thickness of 3 mm. The releasing layer is composed of PFA (a copolymer of tetrafluoroethylene and perfluoroalkoxyethylene) having a thickness of 50 μm. A halogen lamp as a heat source is arranged inside the hollow pipe of the core portion. The heating roller 27 adopts the same structure.

Electric power is supplied to a halogen lamp (not shown) arranged inside each of the fixing roller 26 and the heating roller 27, so that the temperature of the surface of each of the fixing roller 26 and the heating roller 27 increases.

Both ends of the fixing roller 26 are pressurized by a pressurizing spring (not shown), and the fixing roller 26 and the heating roller 27 are brought into press contact with each other to form a fixing nip. An applied pressure at this time is about 80 kgf.

In addition, a fixing nip width in this example is about 10 mm.

Hereinafter, the behavior of a toner image in the fixing nip in this example will be described in detail.

Figure 4:
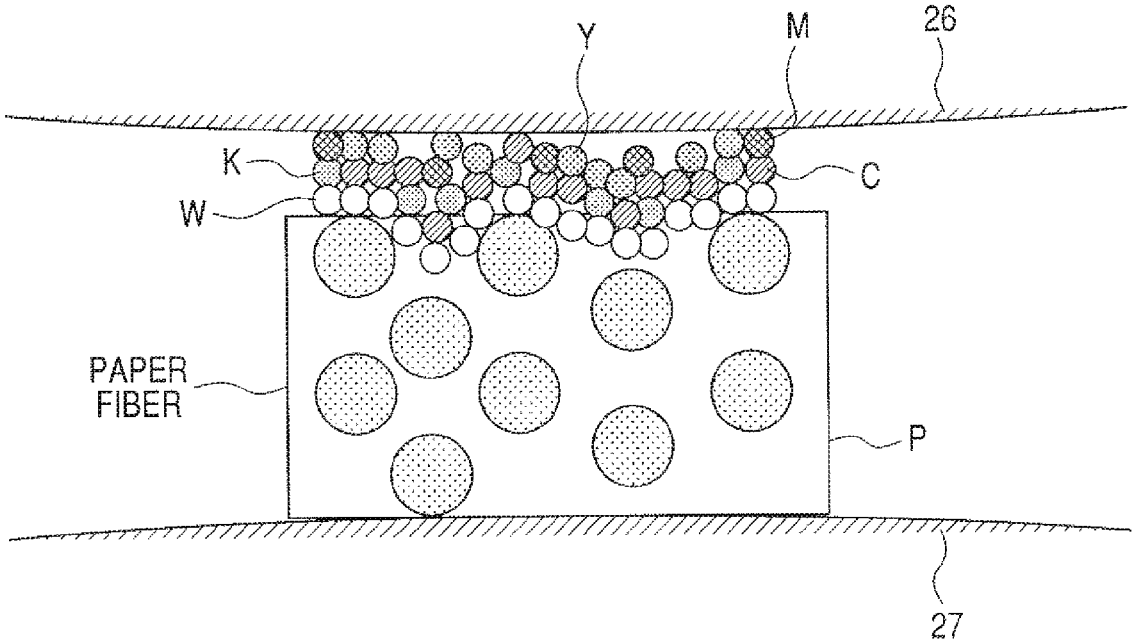
FIG. 4 is an explanatory view showing a state where the toner layers are superimposed at the time of fixation in the example of the present invention.

As shown in FIG. 4, a toner layer is pressurized and heated in the fixing nip by the fixing roller 26 and the heating roller 27 in the fixing unit 25 to be fixed on the transfer material P. At this time, as shown in Table 2, the storage elastic modulus $G'_{(T)}$ (W) at the saturated temperature (T) in the fixing nip of the white toner in contact with the transfer material is higher than the storage elastic modulus at the saturated temperature (T) in the fixing nip of each of the colored toners. Therefore, the white toner transferred so as to be closest to the transfer material P is less likely to melt than each color toner on the surface side of an image, so that the excessive impregnation of the toner image into the transfer material is suppressed. Furthermore, the surface of the toner image sufficiently melts because the toner on the surface side of the image is easy to melt. In addition, the storage elastic modulus $G'_{(T)}$ (W) at the saturated temperature (T) in the fixing nip of the white toner at the time of the fixing step is set to be in the range of $10\times10^4$ dyn/cm$^2$ or more and $1.0\times10^6$ dyn/cm$^2$ or less. As a result, the white toner transferred so as to be closest to the transfer material P melts to such an extent that the toner does not excessively impregnate into a paper fiber of the transfer material P and fixability is not impaired.

Figure 5:
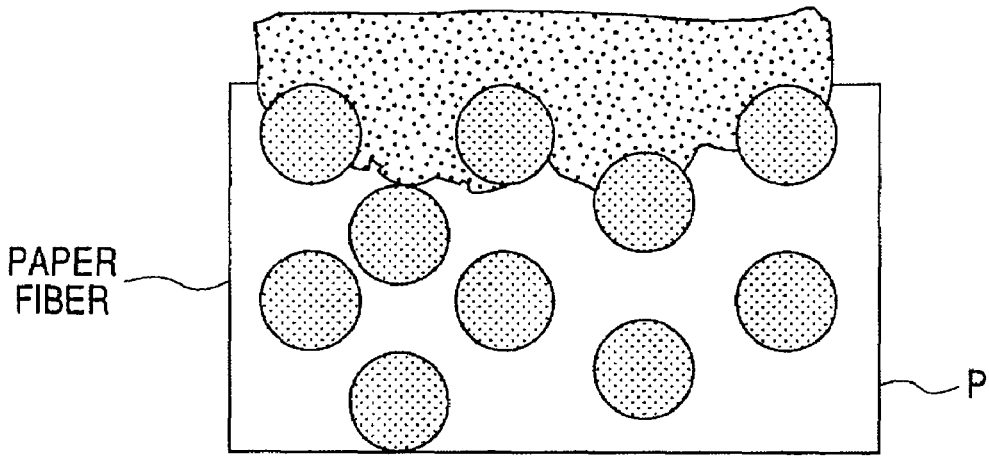
FIG. 5 is an explanatory view showing a state where the toner layers are superimposed after the fixation in the example of the present invention.
Figure 6:
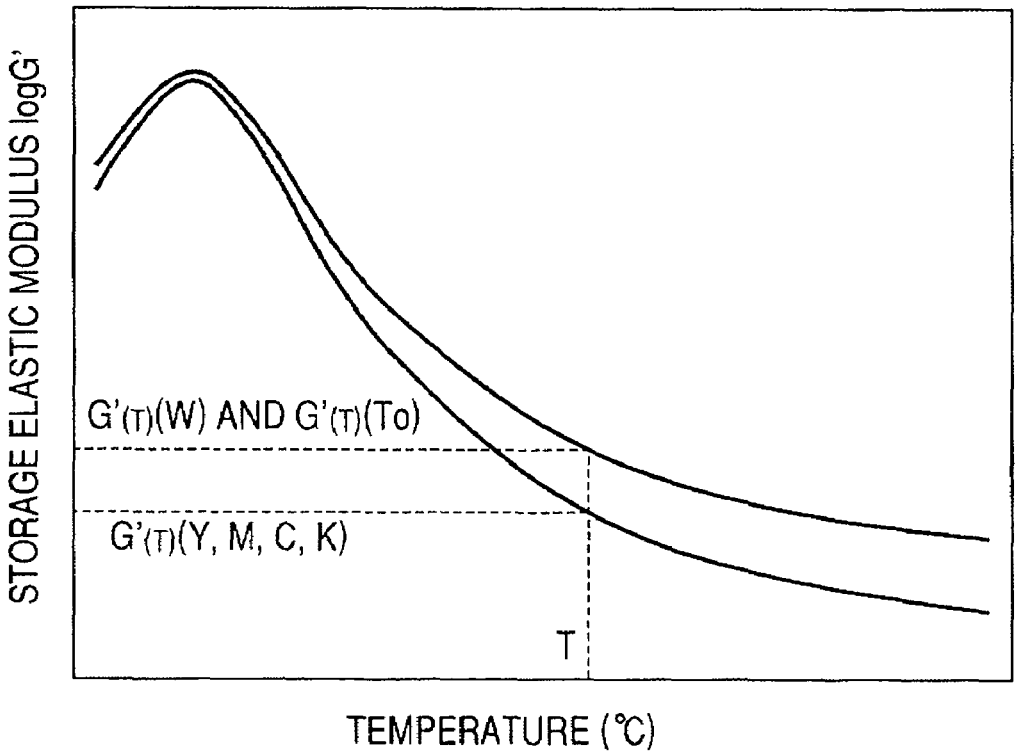
FIG. 6 is an explanatory graph showing the temperature dependence of the storage elastic modulus of toner in the present invention.
Figure 7:
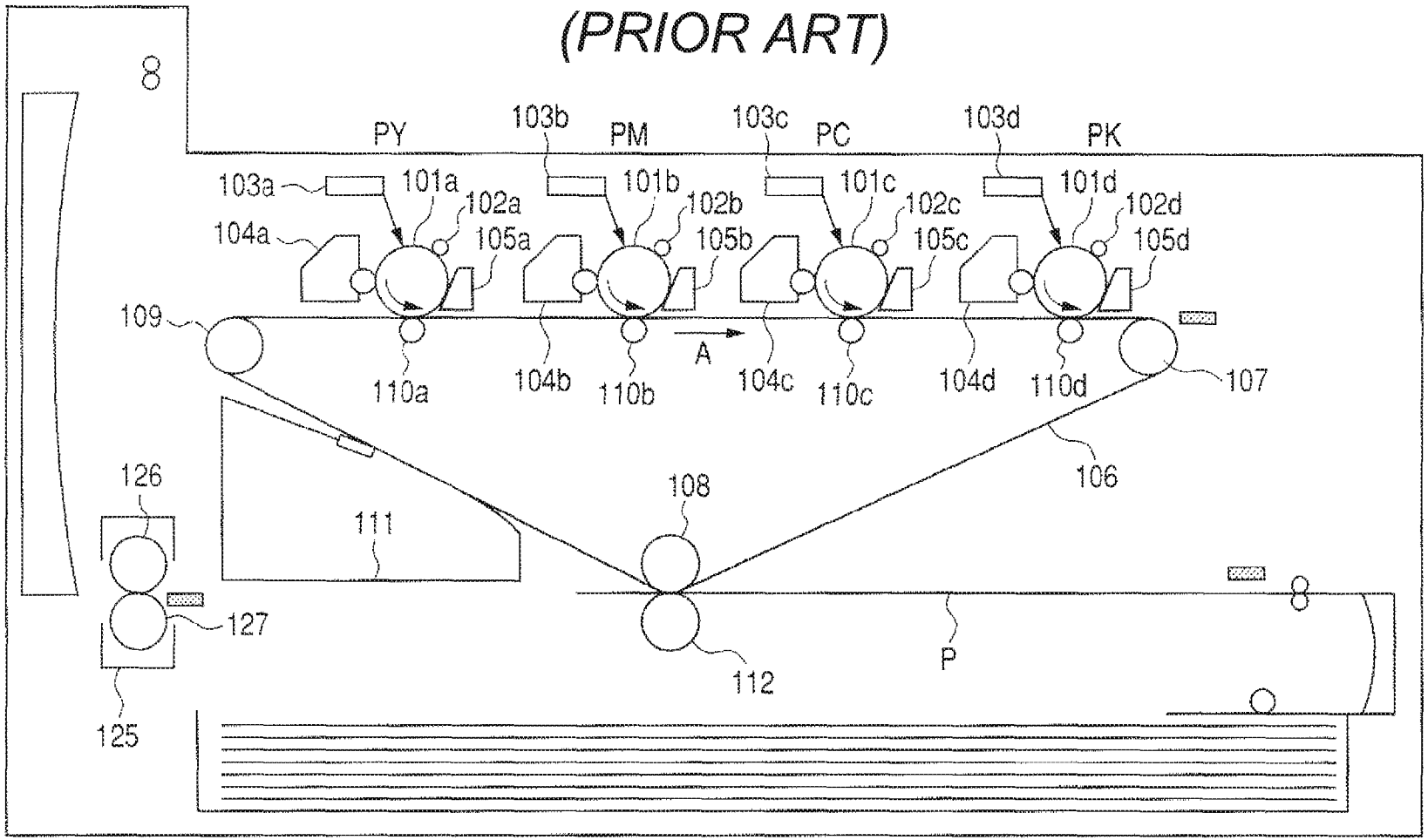
FIG. 7 (PRIOR ART)
FIG. 7 is a structural view showing an example of a conventional image-forming apparatus.
Figure 8:
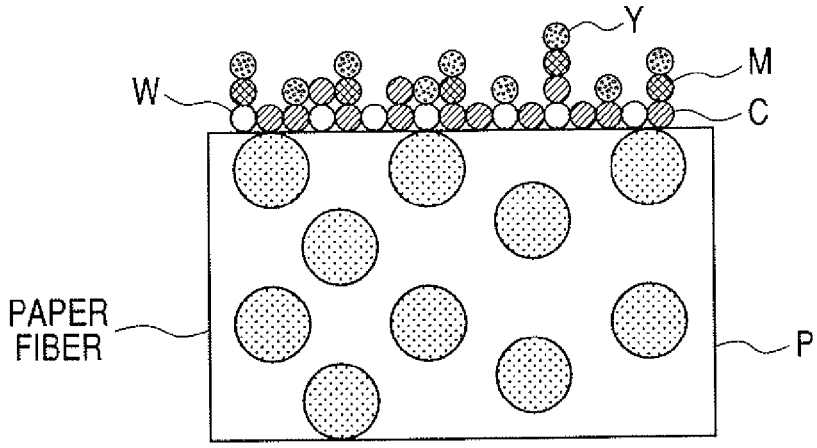
FIG. 8 (PRIOR ART)
FIG. 8 is an explanatory view showing a state where toner layers are superimposed after transfer in a conventional example.
Figure 9:
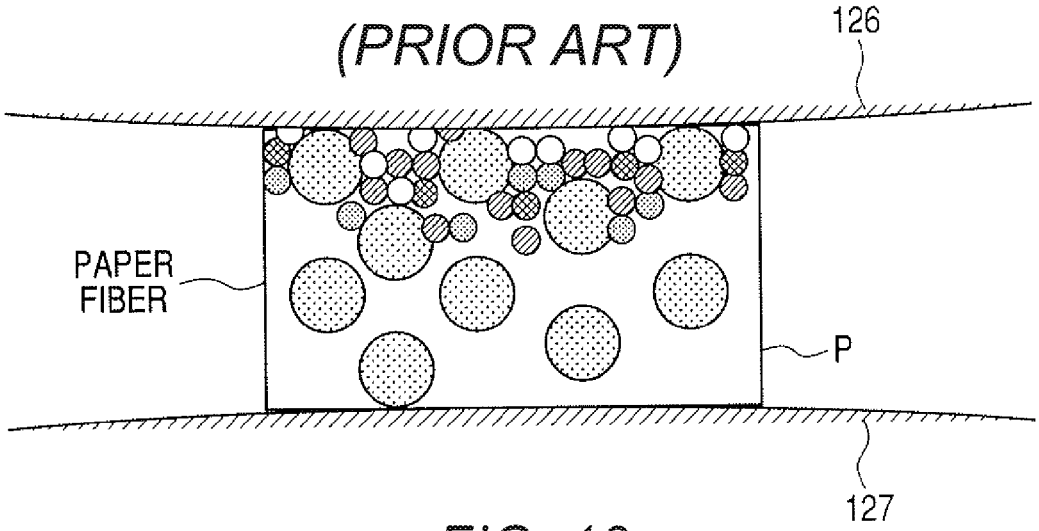
FIG. 9 (PRIOR ART)
FIG. 9 is an explanatory view showing a state where the toner layers are superimposed at the time of fixation in the conventional example.
Figure 10:
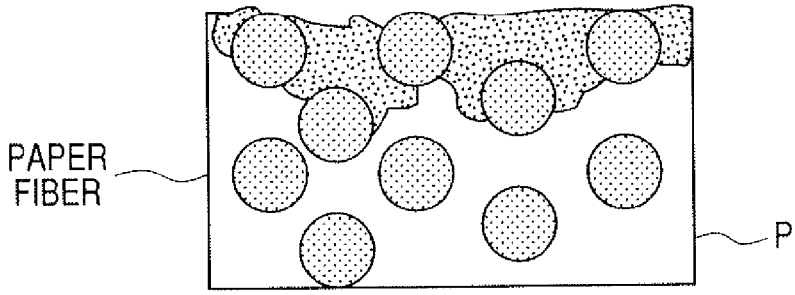
FIG. 10 (PRIOR ART)
FIG. 10 is an explanatory view showing a state where the toner layers are superimposed after the fixation in the conventional example.

That is, the white toner transferred so as to be closest to the transfer material P prevents a multi-color toner image from excessively impregnating into the transfer material, and each colored toner on the surface of the image is sufficiently molten. Then, as shown in FIG. 5, a high-quality image which has a surface with a uniform gloss value, which shows no reduction in image density, and which has good fixability is discharged by a pair of sheet-discharging rollers 28.

As described above, in this example, an image-forming apparatus equipped with a developing device storing white toner as well as four developing devices storing colored toners, that is, yellow toner, magenta toner, cyan toner and black toner is used. Then, an image-forming step of forming a white toner image between a transfer material and a multi-color toner image by developing and transferring the white toner corresponding to the multi-color toner image, and a fixing step of fixing the multi-color toner image and the white toner-image on the transfer material are performed. In addition, the storage elastic modulus $G'_{(T)}$ (W) at a saturated temperature (T) in a fixing nip of the white toner at the time of the fixing step is higher than the storage elastic, modulus at the saturated temperature (T) in the fixing nip of each of the colored toners at the time of the fixing step, and the storage elastic modulus $G'_{(T)}$ (W) at the saturated temperature (T) in the fixing nip of the white toner at the time of the fixing step is in the range of $1.0\times10^4$ dyn/cm$^2$or more and to $1.0\times10^6$ dyn/cm$^2$ or less. As a result, the white toner in contact with the transfer material prevents the multi-color toner image from excessively impregnating into the transfer material, and each colored toner can sufficiently melt at the time of the fixing step. Therefore, a high-quality image which has a surface with a uniform gloss value, which shows no reduction in image density, and which has good fixability can be stably obtained.

EXAMPLE 2

In this example, the same structure and operations were used as in Example 1, except that an image-forming apparatus of an in-line direct transfer system was used and that White Toner 2 was used instead of White Toner 1.

Figure 2:
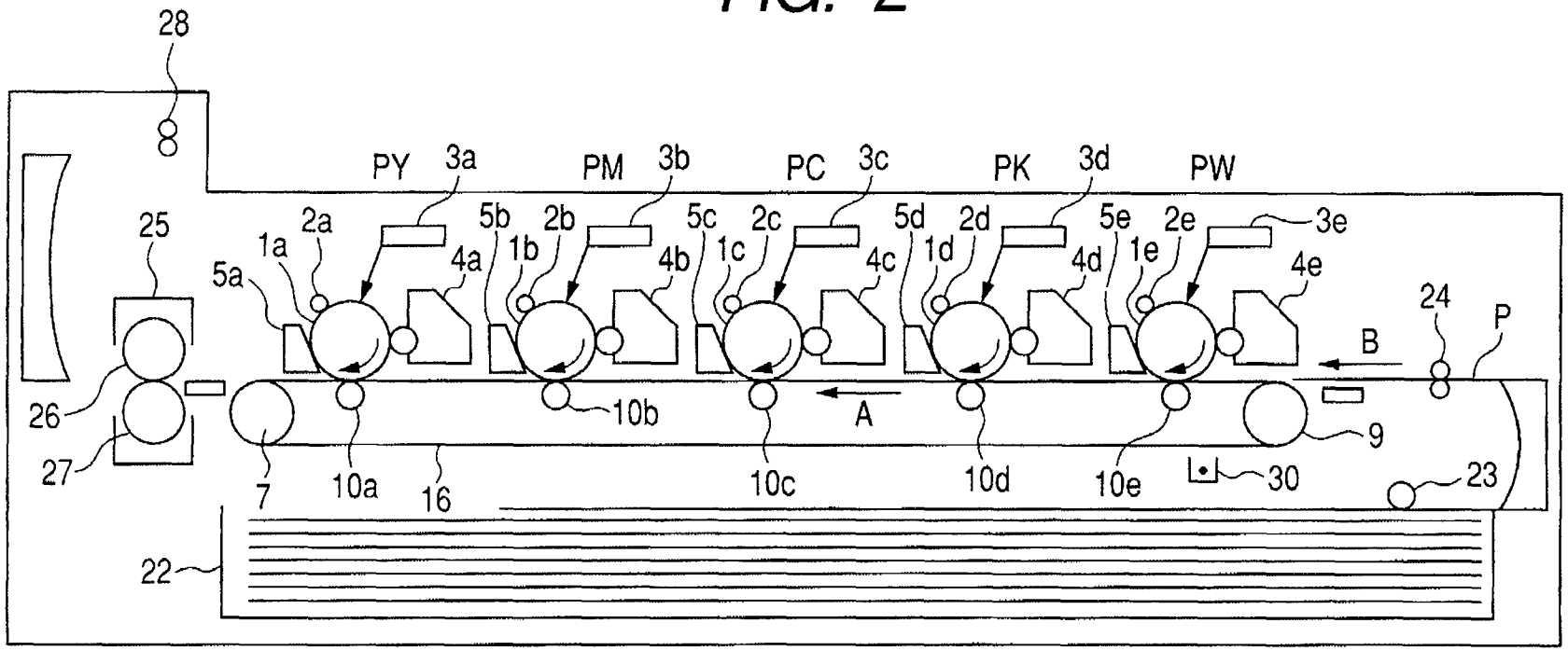
FIG. 2 is a structural view showing a second example of the image-forming apparatus of the present invention.

FIG. 2 is a structural view showing an example of the image-forming apparatus of the present invention. The image-forming apparatus is a color printer of an in-line direct transfer system in which four arrangement stations PY to PK, and an arrangement station PW having a cartridge filled with white toner thereon are arranged in parallel along a sheet-conveying belt 16.

This example is characterized in that: the image-forming apparatus is equipped with a developing device storing white toner as well as four developing devices storing colored toners, that is, yellow toner, magenta toner, cyan toner and black toner; the storage elastic modulus $G'_{(T)}$ (W) at a saturated temperature (T) in a fixing nip of the white toner at the time of a fixing step is higher than the storage elastic modulus at the saturated temperature (T) in the fixing nip of each of the colored toners at the time of the fixing step; and the storage elastic modulus $G'_{(T)}$ (W) at the saturated temperature (T) in the fixing nip of the white toner at the time of the fixing step is in the range of $1.0\times10^4$ dyn/cm$^2$ or more and $1.0\times10^6$ dyn/cm$^2$ or less.

The saturated temperature (T) in the fixing nip and the storage elastic modulus of the toner of each color in this example were measured. Table 2 shows the results.

Hereinafter, an image-forming-operation in the image-forming apparatus will be described.

Each of photosensitive drums 1*a* to 1*e* rotates, and its surface is uniformly charged by the corresponding one of charging devices 2*a* to 2*e*. Next, each of exposing devices 3*a* to 3*e* irradiates a laser beam modulated in accordance with image data, so that a desired electrostatic latent image corresponding to each color is formed on the surface of each of the photosensitive drums 1*a* to 1*e*.

Here, the photosensitive drum 1*e* in the arrangement station PW is irradiated with a laser beam modulated in accordance with all colored image date from the exposing device 3*e*, so that a desired electrostatic latent image is formed on the surface of the photosensitive drum 1*e*.

The electrostatic latent images on the respective photosensitive drums 1*a* to 1*e* are developed at developing positions by the respective developing devices 4*a* to 4*e* with respective toners so as to be visualized as yellow, magenta, cyan, black and white toner images, respectively.

Through the above image-forming operation, at first, in the arrangement station PW for the first color, a white toner image is formed on the photosensitive drum 1*e*. During the formation, a transfer material P is fed from a recording material storage portion 22 such as a cassette by a sheet-feeding roller 23 and conveyed to a pair of resist rollers 24. The transfer material P is temporarily stopped at the pair of resist rollers 24. After that, the transfer material P is conveyed along the sheet-conveying belt 16 to a transfer portion at a predetermined timing by the rotation of the pair of resist rollers 24. The white toner image on the photosensitive drum 1*e* is electrostatically transferred onto the transfer material P at the transfer portion by a voltage, which is opposite in polarity to toner, to be applied to a transfer roller 10*e* arranged inside the sheet-conveying belt 16.

Next, in the arrangement stations PK, PC, PM, and PY for the second, third, fourth and fifth colors, black, cyan, magenta and yellow toner images are formed on the photosensitive drums 1*d*, 1*c*, 1*b*, and 1*a* through similar steps. Next, the toner images are sequentially transferred onto the transfer material P, so that a color image in which toner images of four colors and a white toner image are transferred in a multilayer manner is formed on the transfer material P on the sheet-conveying belt 16.

Residual toner on the photosensitive drums 1 after the transfer is removed by drum cleaners 5 each equipped with a cleaning blade or the like so as to be ready for a next image-forming step.

As shown in. FIG. 3, in the toner images formed by transferring the four colors and the white toner image onto the transfer material P as described above, the white toner image is formed on the transfer material P at a position in contact with the transfer material and the colored toner images are formed on the white toner image as in Example 1. In FIG. 3, M denotes magenta toner, C denotes cyan toner, Y denotes yellow toner, K denotes black toner, and W denotes white toner.

After that, a toner layer is pressurized and heated in a fixing nip by a fixing roller 26 and a heating roller 27 in a fixing unit 25 to be fixed on the transfer material P.

The behavior of a toner image in the fixing nip in this example will be described in detail.

As shown in FIG. 4, a toner layer is pressurized and heated in the fixing nip by the fixing roller 26 and the heating roller 27 in the fixing unit 25 to be fixed on the transfer material P. At this time, as shown in Table 2, the storage elastic modulus $G'_{(T)}$ (W) at the saturated temperature in the fixing nip of the white toner in contact with the transfer material is higher than the storage elastic modulus at the saturated temperature in the fixing nip of each of the colored toners. Therefore, the white toner transferred so as to be closest to the transfer material P is less likely to melt than each color toner on the surface side of an image, so that the excessive impregnation of the toner image into the transfer material is suppressed. Furthermore, the surface of the toner image sufficiently melts because the toner on the surface side of the image is easy to melt. In addition, the storage elastic modulus $G'_{(T)}$ (W) at the saturated temperature in the fixing nip of the white toner at the time of the fixing step is set to be in the range of $1.0\times10^4$ dyn/cm$^2$ or more and $1.0\times10^6$ dyn/cm$^2$ or less. As a result the white toner transferred so as to be closest to the transfer material P melts to such an extent that the toner does not excessively impregnate into a paper fiber of the transfer material P and fixability is not impaired.

That is, the white toner transferred so as to be closest to the transfer material P prevents a toner image from excessively impregnating into the transfer material, and each colored toner on the surface of the image is sufficiently molten. Then, as shown in FIG. 5, a high-quality image which has a surface with a uniform gloss value, which shows no reduction in image density, and which has good fixability is discharged by a pair of sheet-discharging rollers 28.

As described above in this example, even when an image-forming apparatus of a direct transfer system is used, a high-quality image which has a surface with a uniform gloss value, which shows no reduction in image density, and which has good fixability can be stably obtained as in the case of Example 1 under the following conditions. An image-forming step of forming a white toner image between a transfer material and a multi-color toner image is performed. In addition, the storage elastic modulus $G'_{(T)}$ (W) at a saturated temperature in affixing nip of the white toner at the time of the fixing step is higher than the storage elastic modulus at the saturated temperature in the fixing nip of each colored toner, and the storage elastic modulus $G'_{(T)}$ (W) at the saturated temperature in the fixing nip of the white toner at the time of the fixing step is in the range of $1.0\times10^4$ dyn/cm$^2$ or more and $1.0\times10^6$ dyn/cm$^2$ or less.

In addition, as described in this example, even when resin properties of white toner are different, the effects of the present invention can be similarly obtained as long as the storage elastic modulus $G'_{(T)}$ (W) at a saturated temperature in a fixing nip of the white toner at the time of the fixing step is higher than the storage elastic modulus at the saturated temperature in the fixing nip of each colored toner, and the storage elastic modulus $G'_{(T)}$ (W) at the saturated temperature in the fixing nip of the white toner at the time of the fixing step is set to be in the range of $1.0\times10^4$ dyn/cm$^2$ or more and $1.0\times10^6$ dyn/cm$^2$ or less.

EXAMPLE 3

In this example, an image-forming apparatus in which a cartridge filled with Transparent Toner 1 was arranged instead of the cartridge filled with White Toner 1 on the arrangement station PW of FIG. 1 as a structural view of Example 1.

This example is characterized in that: the image-forming apparatus is equipped with a developing device storing transparent toner as well as four developing devices storing colored toners, that is, yellow toner, magenta toner, cyan toner, and black toner; the storage elastic modulus $G'_{(T)}$ (To) at a saturated temperature in a fixing nip of the transparent toner at the time of a fixing step is higher than the storage elastic modulus at the saturated temperature in the fixing nip of each of the colored toners at the time of the fixing step; and the storage elastic modulus $G'_{(T)}$ (To) at the saturated temperature in the fixing nip of the transparent toner at the time of the fixing step is in the range of $1.0\times10^4$ dyn/cm$^2$ or more and $1.0\times10^6$ dyn/cm$^2$ or less.

The saturated temperature (T) in the fixing nip and the storage elastic modulus of the toner of each color in this example were measured. Table 2 shows the results.

The image-forming operation in this image-forming apparatus is the same as that of Example 1, and the image-forming operation in this example resulted in the following effects. That is, the transparent toner in contact with the transfer material prevented a toner image from excessively impregnating into the transfer material, and each colored toner was able to sufficiently melt at the time, of the fixing step. As a result, a high-quality image which has a surface with a uniform gloss value, which shows no reduction in image density, and which has good fixability can be stably obtained.

The shape of the used members and the like are not limited to those shown in this example.

COMPARATIVE EXAMPLE 1

In this comparative example, the same image-forming apparatus and toners as those of Example 1 were used except that White Toner 3 was used instead of White Toner 1. Table 2 shows the storage elastic moduli $G'_{(T)}$ (Y), $G'_{(T)}$ (M), $G'_{(T)}$ (C), $G'_{(T)}$ (K), and $G'_{(T)}$ (W) at a saturated temperature in a fixing nip of the respective toners at the time of a fixing step.

The same image-forming operation as that of Example 1 was performed. Although the storage elastic modulus $G'_{(T)}$ (W) at the saturated temperature in the fixing nip of the white toner at the time of the fixing step was higher than the storage elastic modulus at the saturated temperature in the fixing nip of each of the colored toners at the time of the fixing step, the storage elastic modulus $G'_{(T)}$ (W) at the saturated temperature in the fixing nip of the white toner at the time of the fixing step was higher than $1.0\times10^6$ dyn/cm$^2$. As a result, the white toner in contact with the transfer material insufficiently melted, and an image with insufficient fixability of a toner image on a transfer material such as recording paper was discharged.

COMPARATIVE EXAMPLE 2

In this comparative example, the same image-forming apparatus as that of Example 1 was used except that White Toner 4, Yellow Toner 2, Magenta Toner 2, Cyan Toner, 2 and Black Toner 2 were used instead of White Toner 1, Yellow Toner 1, Magenta Toner 1, Cyan Toner 1 and Black Toner 1. Table 2 shows the storage elastic moduli $G'_{(T)}$ (Y), $G'_{(T)}$ (M), $G'_{(T)}$ (C), $G'_{(T)}$ (K) and $G'_{(T)}$ (W) at a saturated temperature in a fixing nip of the respective toners at the time of a fixing step.

The same image-forming operation as that of Example 1 was performed. Because the storage elastic modulus $G'_{(T)}$ (W) at the saturated temperature in the fixing nip of the white toner at the time of the fixing step was lower than $1.0\times10^4$ dyn/cm$^2$, the white toner in contact with the transfer material excessively impregnated into the transfer material upon melting of the toner, with the result that a paper fiber appeared on the surface of an image. As a result, an image having a surface with lost uniformity of a gloss value lost and having no desired image density was discharged.

COMPARATIVE EXAMPLE 3

In this comparative example, the same image-forming apparatus and toners as those of Example 1 were used except that Yellow Toner 2, Magenta Toner 2, Cyan Toner 2, and Black Toner 2 were used instead of Yellow Toner 1, Magenta Toner 1, Cyan Toner 1, and Black Toner 1. Table 2 shows the storage elastic moduli $G'_{(T)}$ (Y), $G'_{(T)}$ (M), $G'_{(T)}$ (C), $G'_{(T)}$ (K), and $G'_{(T)}$ (W) at a saturated temperature in a fixing nip of the respective toners at the time of a fixing step.

The same image-forming operation as that of Example 1 was performed. Because the storage elastic modulus $G'_{(T)}$ (W) at the saturated temperature in the fixing nip of the white toner at the time of the fixing step was lower than the storage elastic modulus at the saturated temperature in the fixing nip of each of the colored toners at the time of the fixing step, none of the colored toners on the surface of an image sufficiently melted, whereby the gloss value of the surface of the image reduced and therefore a desired image could not be obtained.

TABLE 1

| | Number of parts of divinylbenzene added (unit: part by mass) | |
|---|---|---|
| | White toner or transparent toner | Colored toner |
| Example 1 | 1.0 | 0.5 |
| Example 2 | 0.8 | 0.5 |
| Example 3 | 1.0 | 0.5 |
| Comparative example 1 | 2.0 | 0.5 |
| Comparative example 2 | 0.6 | 0.5 |
| Comparative example 3 | 1.0 | 1.5 |

TABLE 2

| | Saturated temperature in fixing nip (° C.) | $G'_{(T)}(W)$ or $G'_{(T)}(To)$ | Large-small relationship between storage elastic moduli | $G'_{(T)}(Y)$, $G'_{(T)}(M)$ $G'_{(T)}(C)$, $G'_{(T)}(K)$ | Fixability | Gloss value | Density and gloss uniformity |
|---|---|---|---|---|---|---|---|
| Example 1 | 135 | $2.0 \times 10^5$ | > | $1.5 \times 10^4$ | A | A | A |
| Example 2 | 135 | $8.0 \times 10^4$ | > | $1.5 \times 10^4$ | A | A | A |
| Example 3 | 145 | $7.0 \times 10^4$ | > | $4.0 \times 10^3$ | A | A | A |
| Comparative example 1 | 135 | $5.0 \times 10^6$ | > | $1.5 \times 10^4$ | C | B | C |
| Comparative example 2 | 135 | $8.0 \times 10^3$ | > | $4.0 \times 10^3$ | A | B | C |
| Comparative example 3 | 135 | $2.0 \times 10^5$ | < | $7.0 \times 10^5$ | B | C | A |

Evaluation on fixability:

A: Good fixability was obtained.

B: Fixability was slightly bad.

C: An image peeled in some cases.

Evaluation on gloss value:

A: A desired gloss value was obtained.

B: A slight reduction in gloss value was observed.

C: A desired gloss, value could not be obtained.

Evaluation on density and gloss uniformity:

A: Uniform gloss was obtained, and no reduction in density occurred.

B: A portion with slightly uneven gloss was observed, but no reduction in density occurred.

C: Gloss was uneven, and a reduction in density occurred.

This application claims priority from Japanese Patent Application No. 2004-379427 filed Dec. 28, 2004, which is hereby incorporated by reference herein.

What is claimed is:

1. An image-forming apparatus for forming a multi-color toner image by superimposing a plurality of colored toners, the image-forming apparatus comprising:

an image-forming unit that forms a white toner image between a transfer material and the multi-color toner image by developing and transferring white toner corresponding to the multi-color toner image; and a fixing unit that fixes the multi-color toner image and the white toner image on the transfer material, wherein a storage elastic modulus $G'_{(T)}(W)$ at a saturated temperature in a fixing nip of the white toner at a time of the fixing is higher than a storage elastic modulus at a saturated temperature in the fixing nip of each of the colored toners at the time of the fixing, and wherein the storage elastic modulus $G'_{(T)}(W)$ at the saturated temperature in the fixing nip of the white toner at the time of the fixing is $1.0\times10^4$ dyn/cm$^2$ or more and $1.0\times10^6$ dyn/cm$^2$ or less.

2. An image-forming apparatus according to claim 1, wherein the colored toners comprise at least one selected from the group consisting of yellow toner, magenta toner, cyan toner, and black toner.

3. An image-forming apparatus for forming a multi-color toner image by superimposing a plurality of colored toners, the image-forming apparatus comprising:

an image-forming unit that forms a transparent toner image between a transfer material and the multi-color toner image by developing and transferring transparent toner corresponding to the multi-color toner image; and a fixing unit that fixes the multi-color toner image and the transparent toner image on the transfer material, wherein a storage elastic modulus $G'_{(T)}(To)$ at a saturated temperature in a fixing nip of the transparent toner at a time of the fixing is higher than a storage elastic modulus at a saturated temperature in the fixing nip of each of the colored toners at the time of the fixing; and wherein the storage elastic modulus $G'_{(T)}(To)$ at the saturated temperature in the fixing nip of the transparent toner at the time of the fixing step is $1.0\times10^4$ dyn/cm$^2$ or more and $1.0\times10^6$ dyn/cm$^2$ or less.

4. An image-forming apparatus according to claim 3, wherein the colored toners comprise at least one selected from the group consisting of yellow toner, magenta toner, cyan toner, and black toner.

5. An image-forming method of forming a multi-color toner image by superimposing a plurality of colored toners, the image-forming method comprising:

an image-forming step of forming a white toner image between a transfer material and the multi-color toner image by developing and transferring white toner corresponding to the multi-color toner image; and a fixing step of fixing the multi-color toner image and the white toner image on the transfer material, wherein a storage elastic modulus $G'_{(T)}(W)$ at a saturated temperature in a fixing nip of the white toner at a time of the fixing step is higher than a storage elastic modulus at a saturated temperature in the fixing nip of each of the colored toners at the time of the fixing step; and wherein the storage elastic modulus $G'_{(T)}(W)$ at the saturated temperature in the fixing nip of the white toner at the time of the fixing step is $1.0\times10^4$ dyn/cm$^2$ or more and $1.0\times10^6$ dyn/cm$^2$ or less.

6. An image-forming method according to claim 5, wherein the colored toners comprise at least one selected from the group consisting of yellow toner, magenta toner, cyan toner, and black toner.

7. An image-forming method of forming a multi-color toner image by superimposing a plurality of colored toners, the image-forming method comprising:

an image-forming step of forming a transparent toner image between a transfer material and the multi-color toner image by developing and transferring transparent toner corresponding to the multi-color toner image; and a fixing step of fixing the multi-color toner image and the transparent toner image on the transfer material, wherein a storage elastic modulus $G'_{(T)}(To)$ at a saturated temperature in a fixing nip of the transparent toner at a time of the fixing step is higher than a storage elastic modulus at a saturated temperature in the fixing nip of each of the colored toners at the time of the fixing step; and wherein the storage elastic modulus $G'_{(T)}(To)$ at the saturated temperature in the fixing nip of the transparent toner at the time of the fixing step is $1.0\times10^4$ dyn/cm$^2$ or more and $1.0\times10^6$ dyn/cm$^2$ or less.

8. An image-forming method according to claim 7, wherein the colored toners comprise at least one selected from the group consisting of yellow toner, magenta toner, cyan toner, and black toner.

* * * * *